US005253802A

United States Patent [19]

Bernard et al.

[11] Patent Number: 5,253,802

[45] Date of Patent: Oct. 19, 1993

[54] FOLDABLE, MICROWAVABLE BAKING PAN USABLE AS A PROMOTIONAL DEVICE

[75] Inventors: Stuart N. Bernard, Anoka; Christianne L. Strauss; Marsha D. Thompson, both of Minneapolis; Duane R. Mode, Bloomington, all of Minn.

[73] Assignee: General Mills, Inc., Minneapolis, Minn.

[21] Appl. No.: 973,506

[22] Filed: Nov. 9, 1992

[51] Int. Cl.[5] ..... B65D 5/36; B65D 5/42

[52] U.S. Cl. ..... 229/114; 229/117.08; 229/120; 229/171; 229/903; 229/DIG. 14; 426/113; 426/128

[58] Field of Search ..... 229/2, 5 R, 113, 114, 229/117.07, 117.08, 120, 171, 903, DIG. 14; 426/113, 114, 128

[56] References Cited

U.S. PATENT DOCUMENTS

| | | | |
|---|---|---|---|
| 340,915 | 4/1886 | Hurd | 229/117.08 |
| 1,722,338 | 7/1929 | Papendick | 426/128 |
| 1,760,325 | 5/1930 | Small | 229/117.08 |
| 1,954,201 | 4/1934 | Goodyear | 229/114 |
| 2,309,134 | 1/1943 | Morgan | 229/114 |
| 2,547,628 | 4/1951 | Ellsworth . | |
| 2,565,053 | 8/1951 | Stenger . | |
| 2,677,494 | 5/1954 | Buttery . | |
| 2,698,709 | 1/1955 | Neuman | 229/117.07 |
| 3,062,429 | 11/1962 | Liman et al. . | |
| 3,346,399 | 10/1967 | Watson et al. | 426/128 |
| 3,502,488 | 3/1970 | Bridgford | 426/128 |
| 4,111,306 | 9/1978 | Roccaforte | 426/128 |
| 4,373,659 | 2/1983 | Cornell et al. | 229/120 |
| 4,957,237 | 9/1990 | Madonna et al. . | |
| 5,014,853 | 5/1991 | Crockett . | |
| 5,028,000 | 7/1992 | Chabot et al. . | |

FOREIGN PATENT DOCUMENTS

| | | | |
|---|---|---|---|
| 30369 | 11/1959 | Finland | 229/171 |
| 2043598 | 10/1980 | United Kingdom | 229/120 |
| 2087359 | 5/1982 | United Kingdom | 229/171 |

*Primary Examiner*—Gary E. Elkins

*Attorney, Agent, or Firm*—L. MeRoy Lillehaugen; John A. O'Toole; Alan D. Kamrath

[57] ABSTRACT

A pan (10) is formed from a single blank (12) of plastic-coated paperboard and is foldable between a three-dimensional, erect condition and a flat condition. In the flat condition, first and second isosceles trapezoid-shaped side panels (20) are folded about the side edges (18) of a bottom panel (14) to overlie the bottom panel (14) and with their upper edges (22) abutting. Additionally, in the flat condition, first and second triangular panels (34) are folded about the side edges (32) of end panels (28) to overlie the end panels (28). The end panels (28) are in the shape of isosceles trapezoids and are integrally connected to the opposite end edges (16) of the bottom panel (14) and extend continuously therefrom in the flat condition. Attachment panels (38) are foldable about the outer edges (36) of the triangular panels (34) and are secured to the side panels (20) with the side edges (24) of the side panels (20) abutting with and being foldable with the outer edges (36) of the triangular panels (34). In the three-dimensional condition, the side panels (20), the end panels (28), and the triangular panels (34) upstand from the bottom panel (14) to define a volume and form a water-tight container for holding batter. Once erected, tabs (48) can be folded down along a fold line (46) extending across the triangular panels (34) and the end panels (28) at the height of the side panels (20), with the folded tabs (48) helping hold the pan (10) in the erect condition and for use as handles in carrying the pan (10). In the preferred form, parabolic slots (50) are formed in the side panels (20) to prevent overfilling and for safety reasons.

20 Claims, 3 Drawing Sheets

FOLDABLE, MICROWAVABLE BAKING PAN USABLE AS A PROMOTIONAL DEVICE

BACKGROUND

The present invention generally relates to containers, particularly relates to foldable pans, more particularly relates to foldable baking pans, and specifically relates to foldable baking pans for use as a promotional device in the sale of products such as cereal boxes in which such pans are placed in a flat condition.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. Likewise, the promotional device should meet or exceed safety requirements such as set by the Consumer Products Safety Commission for the age group of consumers intended to utilize the promotional device. But most important, the promotional device should have consumer appeal to maximize the promotional value of the device.

Prior promotional devices include items like coupons or the like which are printed on the boxes of the product or which are placed with the product in the boxes of the product, toys and other novelty items which are placed in the boxes of the product, and the like.

It is thus an object of the present invention to provide a baking pan which can be folded to a flat condition.

Another object of the present invention is to provide such a novel foldable baking pan especially adaptable for use as a promotional device in the sale of a product, and especially cereal.

Yet another object of the present invention is to provide such a novel foldable baking pan which is formed from a blank of a single layer of generally stiff material such as plastic-coated paperboard.

It is still further an object of the present invention to provide such a novel foldable baking pan including provisions for preventing overfilling of the pan in its three-dimensional, erect condition for functionality and safety reasons.

SUMMARY

Surprisingly, the above objects can be satisfied in the field of promotional devices and foldable pans such as for microwave baking by providing, in the preferred form of the present invention, a pan which is foldable between a three-dimensional condition with interconnected side, end, and triangular panels integrally upstanding from a bottom panel and a flat condition with the side panels overlying the bottom panel and the first and second triangular panels overlying the end panels extending in a continuous, planar manner from the bottom panel.

In a further aspect of the present invention, slots are formed in the side panels of the pan spaced from the bottom panel and having a lowermost extent spaced from the upper edges of the side panels, with the slots having a width to allow flow of batter therethrough prior to baking but preventing the batter from flowing therethrough during baking.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
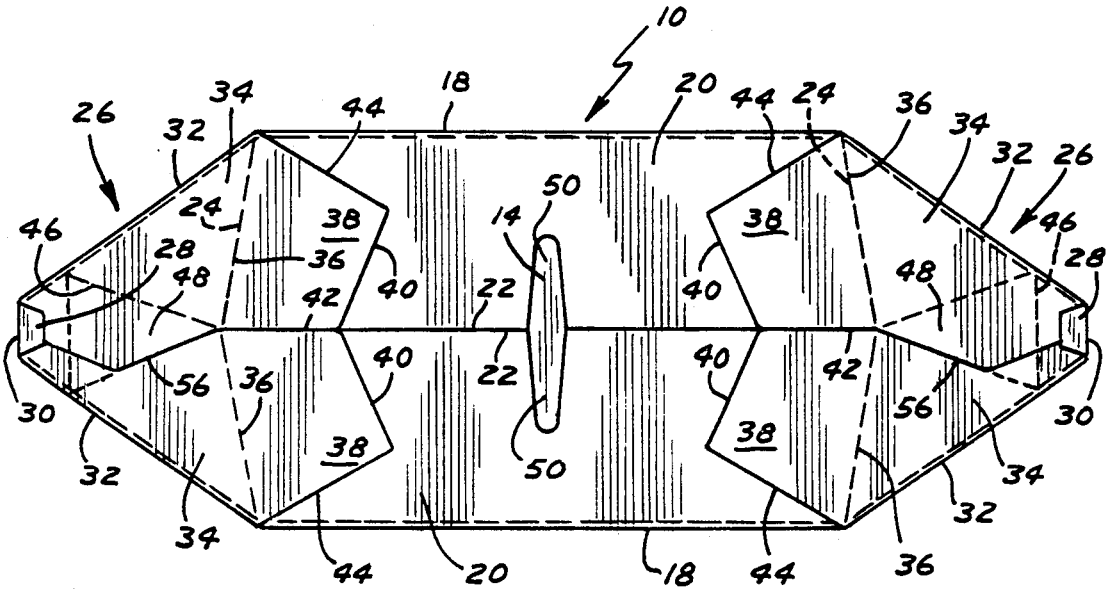
FIG. 1 shows a top plan view of a foldable baking pan according to the preferred teachings of the present invention in its flat condition.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "outer", "inner", "upper", "lower", "height", "width", "end", "side", and similar terms are used herein, it should be understood that these terms have reference only to the structure shown in the drawings as it would appear to a person viewing the drawings and are utilized only to facilitate describing the invention.

DESCRIPTION

Figure 4:
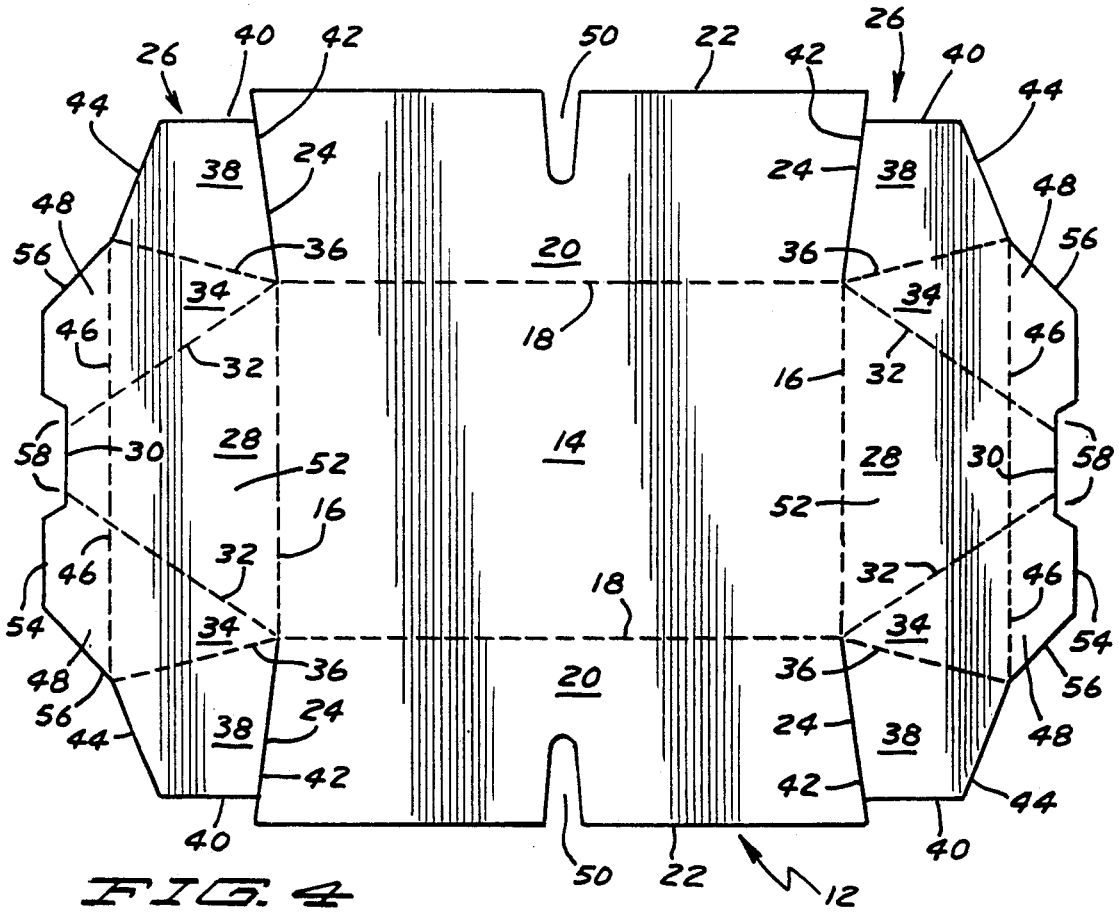
FIG. 4 shows a top plan view of a blank which can be formed into the foldable baking pan of FIG. 1.

A foldable, microwavable pan according to the preferred teachings of the present invention is shown in the drawings and generally designated 10. Pan 10 according to the teachings of the present invention is formed from a blank 12 of a single layer of generally stiff, microwave-transparent material such as plastic-coated paperboard as shown in FIG. 4. Blank 12 generally includes a bottom panel 14 of a generally rectangular configuration including first and second end edges 16 and first and second side edges 18 extending generally perpendicular between edges 16. Blank 12 further includes first and second side panels 20 of a generally isosceles trapezoid shape. Specifically, each panel 20 includes an upper edge 22 comprising the major base of the trapezoid shape, a lower edge 18 comprising the minor base of the trapezoid shape and integrally connected to side edge 18 of panel 14 about a fold line, and first and second, opposite side edges 24 extending at an obtuse angle in the order of 100° from edges 18. Edges 18 of panels 14 and 20 are of identical length. The height between edges 18 and 22 of each panel 20 is generally equal to one-half of the width of panel 14 between edges 18.

Blank 12 also generally includes first and second end portions 26. Each portion 26 includes an end panel 28 of a generally isosceles trapezoid shape having a lower edge 16 comprising the major base of the trapezoid shape and integrally connected to end edge 16 of panel 14 about a fold line, an upper edge 30 comprising the minor base of the trapezoid shape, and first and second, opposite side edges 32. In the most preferred form, edges 32 extend from edges 16 at an acute angle in the order of 55°. Edges 16 of panels 14 and 28 are of identical length. The height between edges 18 and 22 of panels 20 is less than the height between edges 16 and 30 of panels 28.

Each portion 26 further includes first and second obtuse triangular panels 34 having inner side edges 32 integrally connected to side edges 32 of panels 28 about a fold line and outer side edges 36. Side edges 36 extend from edges 16 at an obtuse angle corresponding to the angle between edges 18 and 24 and particularly in the order of 100°.

Each portion 26 further includes first and second attachment panels 38 of a generally trapezoid shape. Specifically, each panel 38 includes an inner edge 36 comprising the major base of the trapezoid shape and integrally connected to side edges 36 of panel 34 about a fold line, an outer edge 40 comprising the minor base of the trapezoid shape, a first lower end edge 42, and a second upper end edge 44. Edges 24 and 42 are coextensive with blank 12 in a flat condition, with edges 42 having lengths less than edges 24. Edges 44 extend at an acute angle from edges 36 corresponding to the angle between edges 22 and 24 an particularly in the order of 80°. The length of edges 36 of panels 38 is generally equal to the length of edges 24 of panels 20.

A fold line 46 extends across panels 28 and 34 parallel to and spaced from edges 16 and at the level of edges 44 to divide panels 28 and 34 into a tab 48 and a closure panel 52. Tab 48 has a generally isosceles trapezoid shape having an outer free edge 54 comprising the minor base of the trapezoid shape, an inner edge 46 comprising the major base of the trapezoid shape and integrally connected to closure panel 52, and first and second opposite side edges 56. In the most preferred form, edges 56 extend at an acute angle in the order of 45° from fold line 46. Portion 52 has a generally isosceles trapezoid shape having a lower edge 16 comprising the minor base of the trapezoid shape and integrally connected to end edge 16 of panel 14 about a fold line, an upper edge 46 comprising the major base of the trapezoid shape and integrally connected to tab 48 about fold line 46, and first and second opposite side edges 36. In the most preferred form, a cut-out 58 is provided in tab 48 of a generally isosceles trapezoid shape having its major base extending along edge 54 and its minor base extending along and having a length greater than edge 30, with cut-out 58 located intermediate edges 56.

In the most preferred form, each panel 20 includes a slot 50 spaced from edge 18, generally intermediate edges 24 and having a lowermost extent spaced from edge 22. Slots 50 in the most preferred form are generally parabolic in shape and extend inwardly from edges 22, with the generally vertically extending sides of slots 50 flaring outwardly for easier piece removal during the manufacture of blank 12. The width of slots 50 must not be too narrow such that the surface tension of water will not prevent passage of the water and batter out of slots 50 and must not be too wide such that the batter will ooze out of slots 50 during cooking, with slots 50 having a width of ⅛ inch (0.32 cm) in the most preferred form when pan 10 is utilized for baking a cake. The spacing of slots 50 from edge 18 is dependent upon the volume of the uncooked batter for the particular recipe being cooked, with the volume defined by pan 10 up to slots 50 being equal to the final volume of the uncooked batter in the most preferred form to allow slots 50 to be utilized as a filling or measuring guide.

To form pan 10 according to the teachings of the present invention, the inner surfaces of panels 38 may be attached to the outer surfaces of panels 20 by any suitable means such as by adhesive to thus secure triangular panels 34 to side panels 20. In the attached condition, edges 24 abut with edges 36, and edges 44 extend generally coextensive with edges 22, with edges 40 of panels 38 being spaced from each other.

Figure 2:
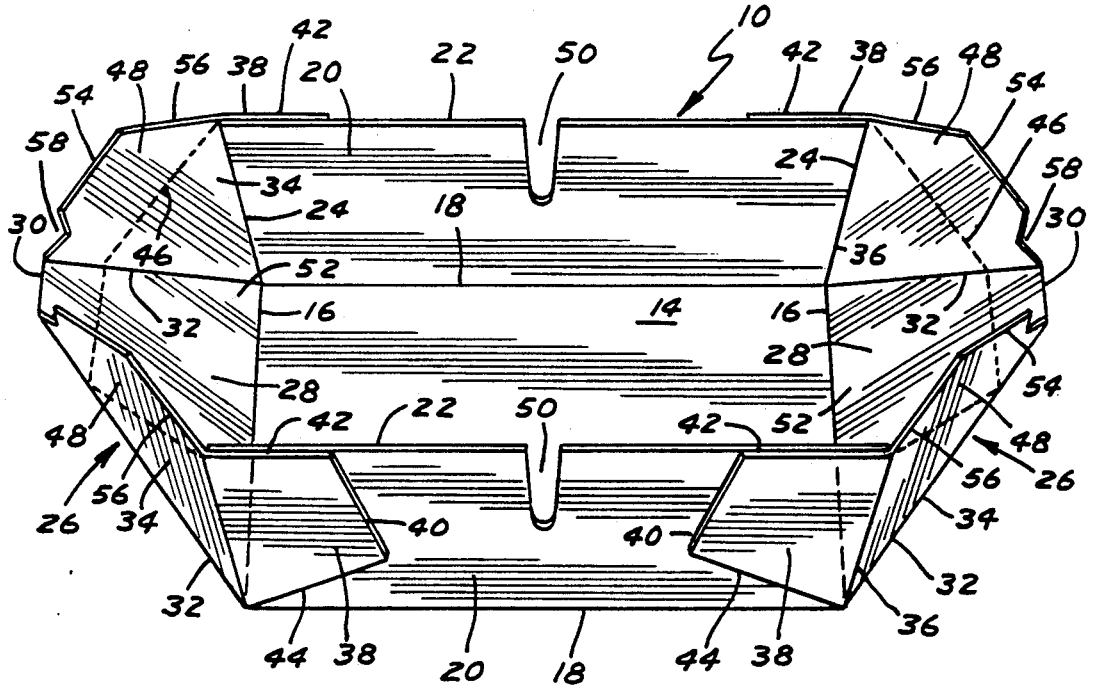
FIG. 2 shows a perspective view of the foldable baking pan of FIG. 1 in its three-dimensional, partially erect condition.
Figure 3:
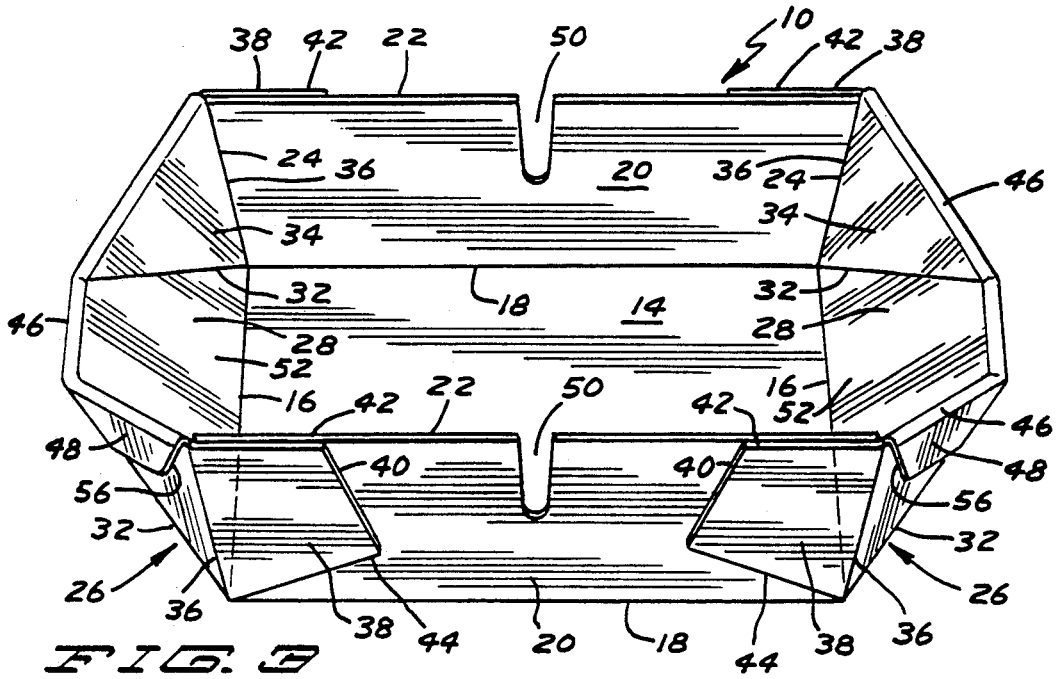
FIG. 3 shows a perspective view of the foldable baking pan of FIG. 1 in its three-dimensional, fully erect condition.
Figure 5:
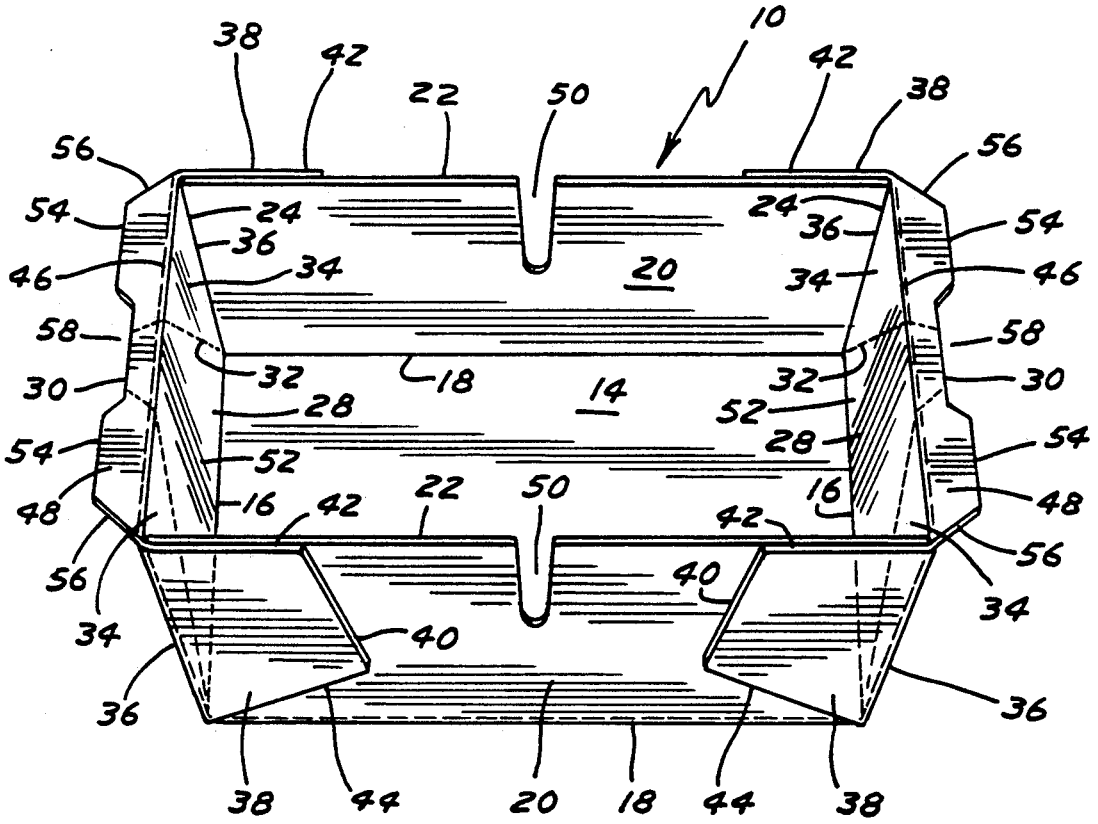
FIG. 5 shows a perspective view of the foldable baking pan of FIG. 1 in an alternate, three-dimensional, fully erect condition.

It should then be appreciated that pan 10 can be formed into a three-dimensional condition to form a water-tight container as shown in FIGS. 2, 3, and 5 for receiving material such as cake batter with panels 20 upstanding from panel 14 defining the sides of pan 10 and panels 28 and 34 upstanding from panel 14 defining the ends of pan 10. In the three-dimensional condition, tabs 48 can be folded outwardly and downward about fold lines 46 with tabs 48 extending generally horizontally and particularly at an angle in the order of 90° from closure panel 52 as shown in FIG. 5, with tabs 48 acting as an angle brace to effectively stop folding of closure panel 52 about edges 32. Tabs 48 in the position of FIG. 5 are especially advantageous for use as handles for carrying pan 10 for both ease of grasping and especially for reduced heat transfer. Specifically, as tabs 48 extend from the water-tight container, tabs 48 remain quite cool even though the baked item and water-tight container in direct contact therewith became quite hot from microwave cooking, with tabs 48 in the position of FIG. 5 reducing the likelihood of burning of the person's fingers when grasped as handles. Additionally, tabs 48 can be folded outwardly and downward about fold lines 46 with tabs 48 abutting with the outer surface of closure panel 52 on each side of pan 10 as shown in FIG. 3. Alternately, tabs 48 can be folded inwardly and downward about fold lines 46 with tab 48 abutting with the inner surface of closure panel 52 on each side of pan 10 if a smooth outer surface of closure panel 52 is desired. Tabs 48 abutting with closure panel 52 such as in the position of FIG. 3 produce a snap, over center with closure panel 52 due to the folding of fold lines 32 over themselves to effectively stop folding of closure panel 52 about edges 32. Thus tabs 48 in their folded positions as shown in FIGS. 3 and 5 hold pan 10 in its fully erect condition. In the preferred form shown, side panels 20 and closure panels 52 flare outwardly when they upstand from panel 14 in the three-dimensional, erect condition.

According to the preferred teachings of the present invention, pan 10 can also be folded into a generally planar or flat condition with panels 28 extending in a continuous, planar manner from bottom panel 14. In the flat condition, panels 20 overlie panel 14, and the ends of panels 20 adjacent edges 24 slightly overlie panels 28. Also, in the flat condition, edges 22 of first and second side panels 20 are in a generally abutting condition. Further, in the flat condition, panels 34 overlie panels 28, with the portion of tab 48 associated with one of panels 34 on each end of pan 12 overlying the portion of tab 48 associated with the other panel 34, with the edges 56 of tabs 48 and fold lines 46 overlying each other in the flat condition. Cut-outs 58 allow edges 30 of panels 28 to be the outermost extent of pan 10 in its flat condition, with the minor base of cut-outs 58 forming blunt ends to pan 10 in its flat condition, and specifically not at sharp points which could be formed if cut-outs 58 were not provided. In the flat condition, pan 10 has a generally diamond shape as shown in FIG. 1.

When pan 10 according to the preferred teachings of the present invention is utilized to hold cake batter during microwave cooking, slots 50 prevent overfilling of the batter, with slots 50 having a width allowing water and uncooked batter to flow therethrough but preventing flow of generally cooked batter therethrough. The inclusion of slots 50 are of a special safety concern when pan 10 is utilized by children where burning by hot water held in pan 10 may occur. Specifically, children may not properly follow the recipe for the particular baked item and specifically may add too much water. With too much water, the batter during cooking may not result in a firm baked item, but rather may turn into a sloppy mixture. This sloppy mixture could be spilled or touched by the children removing it from the microwave oven or otherwise handling it and which may result in burns especially if the mixture was overheated in an attempt to firm up batter including too much water.

It can then be appreciated that pan 10 according to the teachings of the present invention can be utilized as a promotional device and packaged in a flat condition with a packet of the dry ingredients of a baked item such as for a cake. In the most preferred form, the package including pan 10 in its flat condition and the ingredients can be placed in the box of a product such as cereal between the box and the liner for the product or in direct contact with the product in the same manner as other promotional devices are placed, and particularly can be included with the product without requiring different boxes, cartons, or the like.

When the package has been removed from the box of the product and it is desired to bake the item, pan 10 can be unfolded from its flat condition to its three-dimensional condition. Preferably, tabs 48 can be folded downwardly about fold lines 46 to either of the positions of FIGS. 3 and 5 to hold pan 10 in its fully erect condition. At that time, the ingredients from the packet can be emptied into pan 10. A measured amount of liquid such as water can then be poured into pan 10 or alternately liquid can be poured into pan 10 to the level of slots 50, with slots 50 preventing overfilling of pan 10. After mixing, pan 10 with the batter can be placed in a microwave oven for baking. After baking, pan 10 can be removed from the microwave oven utilizing tabs 48 as handles. The outward flare of side panels 20 and closure panels 52 of pan 10 in its three-dimensional, erect condition allows for ease of removal of the cake or other baked item from pan 10. The appeal to a child of baking and consuming his or her own single serving cake or other baked item can certainly be appreciated, with pan 10 utilized in this manner providing maximum promotional value.

In addition to promotional devices for placement with other products, packages including pan 10 in its folded condition and ingredient packets can be also utilized by themselves as giveaway or advertising items which can be handed or mailed to the desired consumer group. Further, although pan 10 is especially adapted to be manufactured in a relatively small size for placement in product boxes as promotional devices, pan 10 can be manufactured in any desired size for use in any application where a single use, baking pan would be desired.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Foldable pan comprising, in combination: a bottom panel having first and second end edges and first and second side edges; first and second side panels integrally connected to and foldable about the first and second side edges, with side panels having opposite edges extending at an obtuse angle from the side edges of the bottom panel; first and second end panels integrally connected to and foldable about the first and second end edges, with the end panels having opposite edges extending at an acute angle from the end edges of the bottom panel; first and second triangular panels integrally connected to and foldable about the opposite edges of each of the end panels, with the triangular panels each further including an outer edge extending at an obtuse angle to the end edges of the bottom panel corresponding to the obtuse angle of the opposite edges of the side panels; and means for abutting the opposite edges of the side panels with the outer edge of the triangular panels, with the triangular panels being foldable about the outer edges relative to the side panels, with the pan being foldable between a three-dimensional condition with the side, end, and triangular panels upstanding from the bottom panel and a flat condition with the side panels overlying the bottom panel and the first and second triangular panels overlying the end panels extending in a continuous, planar manner from the bottom panel.

2. The foldable pan of claim 1 wherein the abutting means comprises, in combination: an attachment panel integrally connected to and foldable about the outer edge of each triangular panel; and means for attaching the attachment panels in attached conditions to the side panels.

3. The foldable pan of claim 2 wherein the side panels have upper edges and are of a generally isosceles trapezoid shape including a minor base, and a major base, with the side edges of the bottom panel comprising the minor base of the trapezoid shape of the side panels and the upper edges of the side panels comprising the major base of the trapezoid shape of the side panels, with each of the attachment panels including a lower edge, with the lower edges of the attachment panels being coextensive to the upper edges of the side panels in their attached conditions.

4. The foldable pan of claim 1 wherein the height of each of the side panels between the upper edge and the side edge of the bottom panel to which the side panel is integrally connected is generally equal to one-half the width between the side edges of the bottom panel, with the upper edges of the side panels abutting when the pan is folded into the flat condition.

5. The foldable pan of claim 4 wherein the end panels have upper edges and are of a generally isosceles trapezoid shape including a minor base, and a major base, with the end edges of the bottom panel comprising the major base of the trapezoid shape of the end panels and the upper edges of the end panels comprising the minor base of the trapezoid shape of the end panels.

6. The foldable pan of claim 5 wherein the side panels have an extent along the opposite edges of the side panels; and wherein the foldable pan further comprises, in combination: tabs secured to each of the triangular panels and having an extent beyond the extent of the side panels, with the tabs of the first and second triangular panels overlying each other when the pan is folded into the flat condition.

7. The foldable pan of claim 6 wherein the tabs are spaced outwardly from the upper edges of the end panels, with the upper edges of the end panels being outermost when the pan is folded into the flat condition.

8. The foldable pan of claim 1 wherein the side panels have an extent along the opposite edges of the side panels; and wherein the foldable pan further comprises, in combination: tabs secured to each of the triangular panels and having an extent beyond the extent of the side panels, with the tabs of the first and second triangular panels overlying each other when the pan is folded into the flat condition.

9. The foldable pan of claim 8 wherein the end panels have upper edges and are of a generally isosceles trapezoid shape including a minor base, and a major base, with the end edges of the bottom panel comprising the major base of the trapezoid shape of the end panels and the upper edges of the end panels comprising the minor base of the trapezoid shape of the end panels.

10. The foldable pan of claim 9 wherein the tabs are spaced outwardly from the upper edges of the end panels, with the upper edges of the end panels being outermost when the pan is folded into the flat condition.

11. The foldable pan of claim 10 wherein the side panels have upper edges and are of a generally isosceles trapezoid shape including a minor base, and a major base, with the side edges of the bottom panel comprising the minor base of the trapezoid shape of the side panels and the upper edges of the side panels comprising the major base of the trapezoid shape of the side panels; and wherein the height of each of the side panels between the upper edge and the side edges is generally equal to one-half the width between the side edges of the bottom panel, with the upper edges of the side panels abutting when the pan is folded into the flat condition.

12. The foldable pan of claim 1 wherein the side panels have upper edges and are of a generally isosceles trapezoid shape including a minor base, and a major base, with the side edges of the bottom panel comprising the minor base of the trapezoid shape of the side panels and the upper edges of the side panels comprising the major base of the trapezoid shape of the side panels.

13. The foldable pan of claim 1 wherein the end panels have upper edges and are of a generally isosceles trapezoid shape including a minor base, and a major base, with the end edges of the bottom panel comprising the major base of the trapezoid shape of the end panels and the upper edges of the end panel comprising the minor base of the trapezoid shape of the end panels.

14. The foldable pan of claim 1 further comprising, in combination: slots in each of the side panels spaced from the side edges and having a lowermost extent spaced from the upper edges of the side panels to prevent overfilling of the pan, with the slots having a width to allow flow of batter therethrough prior to baking but preventing the batter from flowing therethrough during baking.

15. The foldable pan of claim 1 further comprising, in combination: first and second fold lines parallel to and spaced from the end edges and across the end panels and the triangular panels, with tabs being defined by the fold lines opposite to the end edges, with the tabs being foldable about the fold lines to hold the pan in its three-dimensional condition.

16. The foldable pan of claim 15 wherein the tabs have a generally isosceles trapezoid shape including a major base, with the major base of the generally isosceles trapezoid shape of the tabs extending along the fold lines, with the tabs including first and second opposite side edges which overlie the fold lines in the flat condition.

17. In a pan for holding batter for baking into a baked item, with the pan including a bottom panel and at least a first side upstanding from the bottom panel to define a volume, with the first side including an upper edge, with the improvement comprising a slot spaced from the bottom panel and having a lowermost extent spaced from the upper edge of the side, with the volume defined by the bottom panel and the side up to the slot being sufficient to hold the batter before baking, with the slot having a width to allow flow of the batter therethrough prior to baking but preventing the batter from flowing therethrough during baking.

18. The pan of claim 17 wherein the width of the slot is in the order of ⅛ inch (0.32 cm).

19. The pan of claim 18 wherein the slot extends from the upper edge of the side.

20. The pan of claim 19 wherein the bottom panel and side are formed of microwave-transparent material.

* * * * *